United States Patent [19]

Boogers

[11] 4,269,202

[45] May 26, 1981

[54] METHOD AND DEVICE FOR STRETCHING TOBACCO LEAVES OR PORTIONS THEREOF

[75] Inventor: Wilhelmus P. L. Boogers, Eindhoven, Netherlands

[73] Assignee: Arenco P.M.B. B.V., Best, Netherlands

[21] Appl. No.: 897,862

[22] Filed: Apr. 19, 1978

[51] Int. Cl.[3] ..... A24B 3/00; A24B 3/16; A24B 3/18

[52] U.S. Cl. ..... 131/290; 131/311

[58] Field of Search ..... 131/120, 122, 123, 126, 131/127, 128-132, 145, 146, 147, 149

[56] References Cited

U.S. PATENT DOCUMENTS 3,800,807 4/1974 Hays ..... 131/147

*Primary Examiner*—V. Millin

*Attorney, Agent, or Firm*—John P. Snyder

[57] ABSTRACT

A method and a device for stretching a tobacco leaf or portions thereof, which is distinguished in that each tobacco leaf is deposited on an omnidirectionally elastic, substantially flat carrier, pressure is exerted on the leaf on the side remote from the carrier and subsequently adequate tensile force is exerted around the leaf in a plane of the carrier in order to stretch the leaf by friction with excessive tensile force without the risk of damage of the leaf, since only the friction between the leaf and the carrier is responsible for the stretching effect.

9 Claims, 2 Drawing Figures

METHOD AND DEVICE FOR STRETCHING TOBACCO LEAVES OR PORTIONS THEREOF

The invention relates to a method and a device for stretching a tobacco leaf or portions thereof.

For working up tobacco leaf material the leaf must be in a stretched shape. The operations to which the leaf is subjected may consist of checking the leaf for holes, cracks or other defects, of determining the circumference thereof or of cutting the tobacco leaf into suitable shapes. The natural tobacco leaf supplied from a store is conditioned in humidity and temperature, but it has a wrinkled form. The wrinkles are not orientated in one direction so that stretching of the tobacco leaf on all sides is necessary.

The invention provides a method for this purpose, which is distinguished in that each tobacco leaf is depostied on an omnidirectionally elastic, substantially flat carrier, pressure is exerted on the leaf on the side remote from the carrier and subsequently adequate tensile force is exerted around the leaf in a plane of the carrier in order to stretch the leaf by friction with excessive tensile force.

With this method the leaf is stretched without the risk of damage of the leaf, since only the friction between the leaf and the carrier is responsible for the stretching effect, said friction being a function of the pressure by which the leaf is held on the carrier. This pressure can be readily adapted to the nature and the kind of tobacco leaf to be treated.

According to the invention the pressure required for producing the friction between leaf and carier can be obtained by pressing a pressure member located opposite the carrier against the leaf. If necessary, this pressure member in an omnidirectionally elastic form can be simultaneously stretched with the carrier.

As an alternative, in accordance with the invention, vacuum may be produced on the side of the carrier remote from the leaf, so that the leaf is sucked against the supporting surface and the required pressure is obtained.

Of course, combinations of the pressure member and the vacuum are also possible.

The invention furthermore provides a device for carrying out said methods, said device being distinguished in that it comprises a cabinet communicating with an exhaust member and having an open wall with an interrupted rim, an elastic permeable, skin-like leaf carrier extending across the opening as far as beyond the rim thereof and drawing means engaging the carrier beyond the rim.

The invention will be described more fully with reference to an embodiment.

Figure 1:
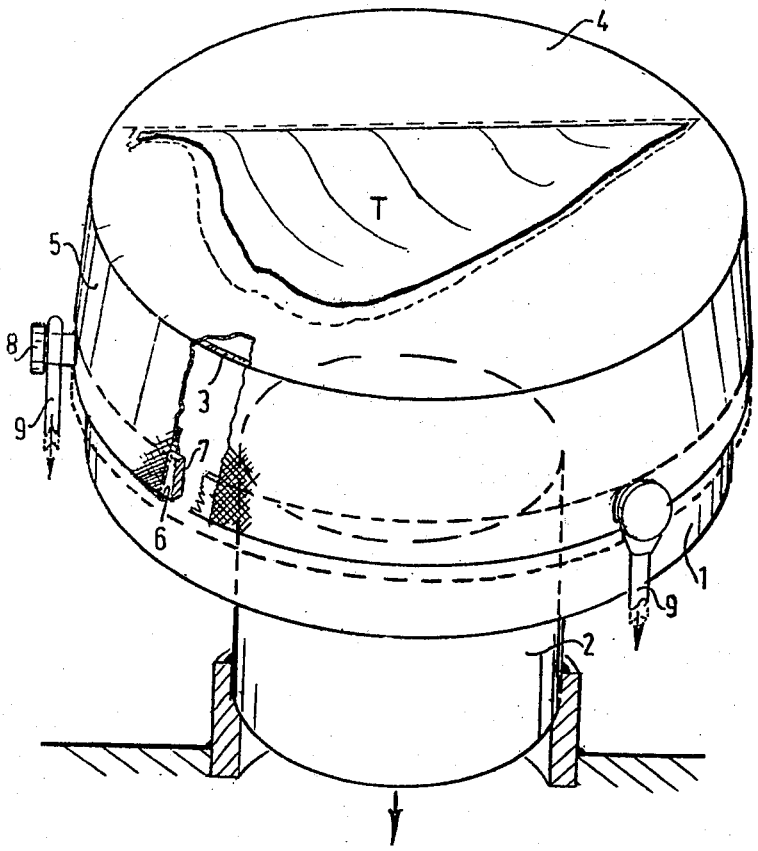
FIG. 1 is an elevational view of the invention.

Referring to the accompanying FIG. 1, a cylindrical vacuum cabinet 1 communicates with an exhaust device not shown in detail through a connecting stub 2 on the bottom side of the cabinet.

The head face of the cylindrical vacuum cabinet 1 is open so that on the top side a rim 3 corresponding to the end edge of the jacket-like cylinder is obtained.

The opening on the top side is closed by a skin-like carrier 4 stretched across the same as far as beyond the rim 3, where the skin-like carrier 4 is prolonged by a skirt -like portion 5, which terminates in a folded over seam 6. In the seam 6 is included a ring 7, which fits around the cylindrical jacket of the cabinet 1. This ring 7 serves as a drawing member and is provided with radially projecting cams 8, to which are fastened drawing means 9 (not shown).

The device operates as follows. After the cylindrical cabinet 1 is exhausted, a leaf T is deposited on the skin-like carrier 4 within the rim 3. The position of the leaf is indicated by the solid line in the FIG. 1. The ring 7 occupies the position shown.

Subsequently, by the drawing means 9 the ring 7 is pulled down along the jacket of the cabinet 1 to the broken line in the Figure, so that the skin-like carrier 4 is drawn across the rim 3 and an omnidirectional, radially extending tensile stress is produced in the plane of the carrier. Owing to the friction between the leaf T and the top surface of the carrier 4 the leaf is stretched, for example, up to the broken line in the FIG. 1.

As a matter of course, other embodiments are possible within the scope of the invention. For example, the cabinet 1 need not have a circle-cylindrical shape, since it may have any desired shape. The uninterrupted rim 3, however, is essential for stretching the skin-like carrier 4. This rim 3 may form the boundary of a much elongated, slot-like opening, in which case the carrier 4 can be displaced in a direction of length, whilst the skin-like carrier is increasingly stretched.

According to a further development of the method according to the invention a pressure member is arranged opposite the supporting face 4 of the carrier, the surface of which is complementary to that of the carrier 4. Moreover, the circumference may correspond with the circumference of the rim 3. When a pressure member impermeable to air is employed, it is advantageous to provide a smooth surface for this pressure member on the operative side. This involves that the leaf T can be stretched with the carrier 4 unhindered, that is to say, without friction.

Figure 2:
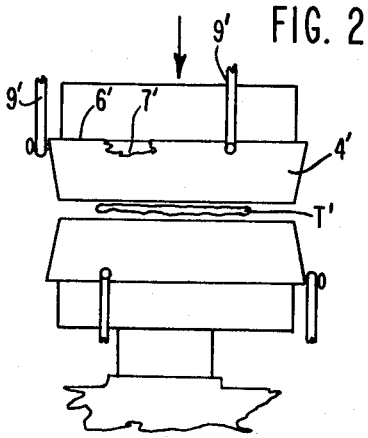
FIG. 2 is a side view of a modified embodiment of the invention.

In the case of a pressure member 4' having a more or less rough surface, it is advantageous to ensure omnidirectional elasticity for this pressure member and to stretch the same, for example, by the corresponding draw means 6', 7', 8' and 9' along a cylindrical surface of a cylinder in opposite position as shown in FIG. 2. Thus the stretching effect on the leaf T is enhanced.

Preferably, the pressure member is in both cases impermeable to air so that along the leaf T no spurious air can be sucked in and the vacuum can thus be readily obtained.

What is claimed is:

1. A method of stretching a tobacco leaf or portions thereof characterized by the deposition of each tobacco leaf on an omnidirectionally elastic carrier, by exerting a pressure on the leaf on the side remote from the carrier and by subsequently applying adequate tensile stress around the leaf in the plane of the carrier in order to stretch the leaf omnidirectionally by an excessive extension of the carrier.

2. A method as claimed in claim 1 characterized by producing vacuum on the side of the carrier remote from the leaf in order to exert pressure on the leaf.

3. A method as claimed in claim 1 characterized in that a pressure member arranged opposite the surface of the carrier is moved towards the carrier in order to press the leaf against the surface of the carrier.

4. A method as claimed in claim 3 characterized in that when a tensile stress is produced in the plane of the carrier, a tensile force is simultaneously applied in the plane of the omnidirectionally elastic pressure member around the leaf.

5. A method as claimed in claim 3 or 4 characterized in that the pressure member is formed by a skin-like member impermeable to air.

6. A device for stretching tobacco leaves which comprises a hollow cabinet having an opening defining a rim, an omnidirectionally elastic, permeable, skin-like leaf carrier disposed over said opening, means for subjecting the interior of said cabinet to vacuum so as to hold a tobacco leaf against said carrier, and means around said rim and engaging said carrier for omnidirectionally stretching said carrier thereby to smooth a tobacco leaf held against said carrier.

7. A method of stretching a tobacco leaf or portion thereof comprising the steps of:

(a) providing an omnidirectionally elastic carrier;

(b) depositing a tobacco leaf on said carrier;

(c) holding said tobacco leaf on said carrier with a predetermined pressure such that predetermined frictional engagement is maintained between said tobacco leaf and said carrier and;

(d) omnidirectionally stretching said carrier, while maintaining step (c), by an amount sufficient to stretch said tobacco leaf to an extended state.

8. A method of stretching a tobacco leaf or portion thereof as claimed in claim 7 including the step of maintaining said carrier in a stationary position while carrying out steps (b) through (d).

9. A method of stretching a tobacco leaf or portion thereof as claimed in claim 7 or 8 including the step of controlling the stretching of said carrier so as to be omnidirectionally uniform.

* * * * *